US009053647B1

(12) United States Patent
Fricke

(10) Patent No.: US 9,053,647 B1
(45) Date of Patent: Jun. 9, 2015

(54) HANDS FREE HOLDING ASSEMBLY

(71) Applicant: Chris D. Fricke, Mount Gilead, OH (US)

(72) Inventor: Chris D. Fricke, Mount Gilead, OH (US)

( * ) Notice: Subject to any disclaimer, the term of this patent is extended or adjusted under 35 U.S.C. 154(b) by 0 days.

(21) Appl. No.: 14/285,855

(22) Filed: May 23, 2014

(51) Int. Cl.
*G09F 3/20* (2006.01)
*G09F 7/18* (2006.01)

(52) U.S. Cl.
CPC . *G09F 7/18* (2013.01); *G09F 3/204* (2013.01)

(58) Field of Classification Search
CPC ..... A47B 23/04; A47B 23/042; A47B 97/02; A47B 21/045; B41J 29/15; G06F 1/1611; G06F 1/1607; G09F 3/204
USPC ..... 40/606.12, 650, 660; 248/447.1, 442.2, 248/441.1
See application file for complete search history.

(56) References Cited

U.S. PATENT DOCUMENTS

| | | | | | |
|---|---|---|---|---|---|
| 1,531,229 | A | * | 3/1925 | Bernstein | 40/658 |
| 1,744,196 | A | * | 1/1930 | Ames | 248/539 |
| 2,751,653 | A | * | 6/1956 | Leibow | 24/331 |
| 3,168,276 | A | | 2/1965 | Schneider | |
| D233,871 | S | | 12/1974 | Dexter | |
| 4,023,763 | A | | 5/1977 | Pulley | |
| D252,578 | S | | 8/1979 | Charowhas | |
| 4,449,310 | A | * | 5/1984 | Kline | 40/658 |
| 4,991,806 | A | | 2/1991 | Nakamura et al. | |
| 5,388,284 | A | * | 2/1995 | Garnett | 4/503 |
| 5,451,101 | A | * | 9/1995 | Ellison et al. | 312/223.6 |
| 6,439,534 | B1 | * | 8/2002 | Hensel | 248/447.1 |
| 7,228,653 | B2 | | 6/2007 | Byrne et al. | |
| D607,061 | S | * | 12/2009 | Kosir | D20/44 |
| 2004/0049961 | A1 | | 3/2004 | Byrne et al. | |

* cited by examiner

*Primary Examiner* — Casandra Davis

(57) ABSTRACT

A hands free holding assembly for retaining a placard proximate a user includes an engaging portion of a holder that may be operationally coupled to a fixture. The holder is retained on the fixture so a retaining portion of the holder is directed away from the fixture. The retaining portion of the holder may engage the placard. The placard is retained at a position is visible to a user.

9 Claims, 3 Drawing Sheets

HANDS FREE HOLDING ASSEMBLY

BACKGROUND OF THE DISCLOSURE

Field of the Disclosure

The disclosure relates to hands free holding devices and more particularly pertains to a new hands free holding device for retaining a placard proximate a user.

SUMMARY OF THE DISCLOSURE

An embodiment of the disclosure meets the needs presented above by generally comprising an engaging portion of a holder that may be operationally coupled to a fixture. The holder is retained on the fixture so a retaining portion of the holder is directed away from the fixture. The retaining portion of the holder may engage the placard. The placard is retained at a position is visible to a user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
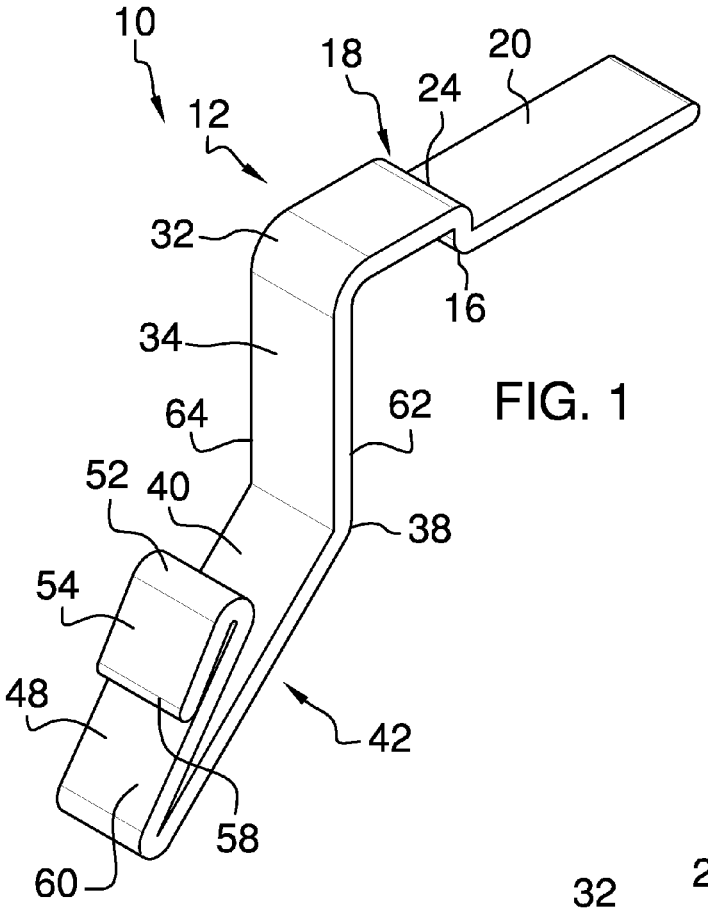
FIG. 1 is a front perspective view of a hands free holding assembly according to an embodiment of the disclosure.
Figure 2:
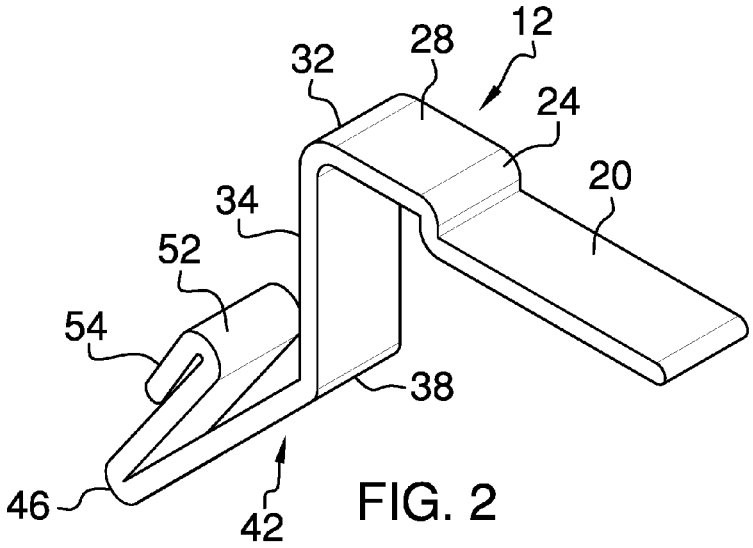
FIG. 2 is a back perspective view of an embodiment of the disclosure.
Figure 3:
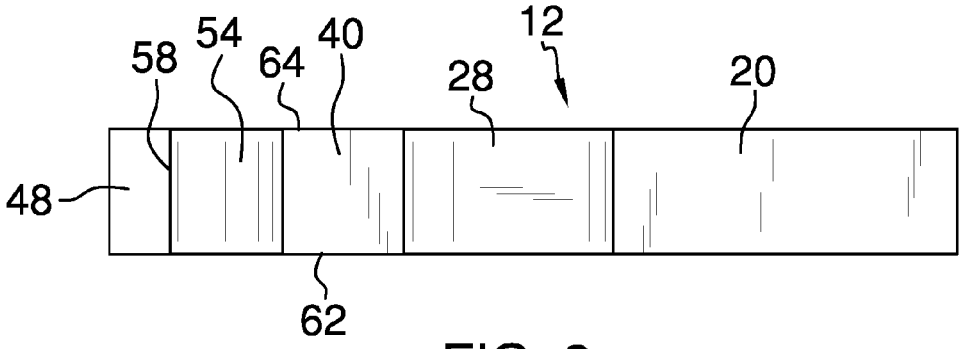
FIG. 3 is a top view of an embodiment of the disclosure.
Figure 4:
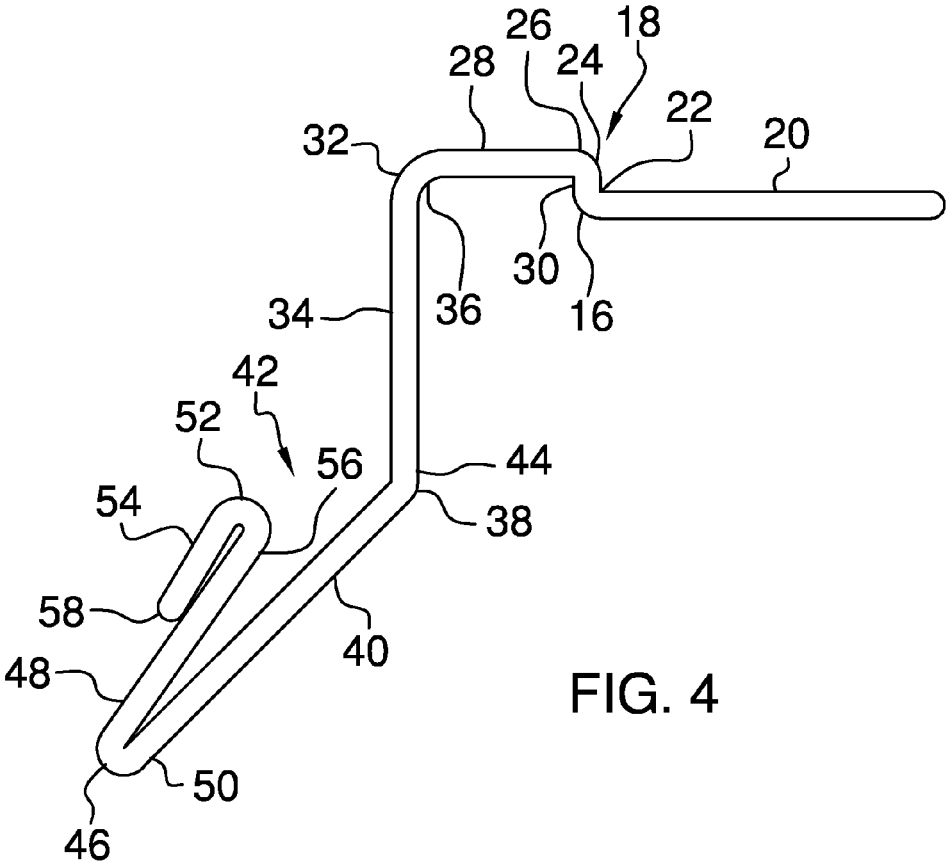
FIG. 4 is a left side view of an embodiment of the disclosure.
Figure 5:
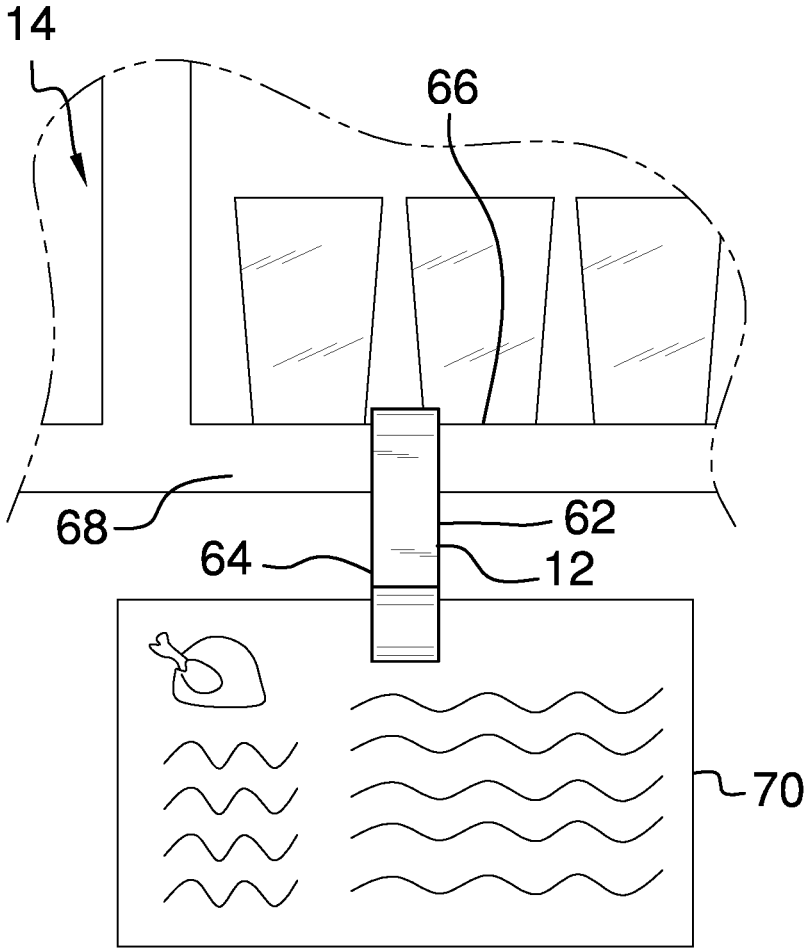
FIG. 5 is an in-use view of an embodiment of the disclosure.

With reference now to the drawings, and in particular to FIGS. 1 through 5 thereof, a new hands free holding device embodying the principles and concepts of an embodiment of the disclosure and generally designated by the reference numeral 10 will be described.

As best illustrated in FIGS. 1 through 5, the hands free holding assembly 10 generally comprises a holder 12 that may be coupled to a fixture 14. The fixture 14 may be a kitchen cabinet of any conventional design. Additionally, the holder 12 may have a width between 2 cm and 4 cm. The holder 12 may be comprised of a resiliently bendable and translucent material such as acrylic or other similar material.

A first bend 16 on an engaging portion 18 of the holder 12 defines a rear arm 20 of the engaging portion 18 of the holder 12. The rear arm 20 of the engaging portion 18 of the holder 12 extends rearwardly away from a bottom end 22 of an abutting section 24 of the engaging portion 18 of the holder 12. The rear arm 20 of the engaging portion 18 of the holder 12 may have a length between 5 cm and 8 cm. Lastly, the abutting section 24 of the engaging portion 18 of the holder 12 may have a length between 6 mm and 12 mm.

A second bend 26 of the engaging portion 18 of the holder 12 defines a front arm 28 of the engaging portion 18 of the holder 12. The front arm 28 of the engaging portion 18 of the holder 12 extends forwardly away from a top end 30 of the abutting section 24 of the engaging portion 18 of the holder 12. Moreover, the front arm 28 of the engaging portion 18 of the holder 12 may have a length between 2 cm and 3 cm.

A third bend 32 of the engaging portion 18 of the holder 12 defines a lower arm 34 of the engaging portion 18 of the holder 12. The lower arm 34 of the engaging portion 18 of the holder 12 extends downwardly from a front end 36 of the front arm 28 of the engaging portion 18 of the holder 12. Further, the lower arm 34 of the engaging portion 18 of the holder 12 forms a right angle with respect to the front arm 28 of the engaging portion 18 of the holder 12. Lastly, the lower arm 34 of the engaging portion 18 of the holder 12 may have a length between 5 cm and 8 cm.

A fourth bend 38 of the holder 12 defines a rear arm 40 of a retaining portion 42 of the holder 12. The rear arm 40 of the retaining portion 42 of the holder 12 extends forwardly and downwardly from a bottom end 44 of the lower arm 34 of the engaging portion 18 of the holder 12. Moreover, the rear arm 40 of the retaining portion 42 of the holder 12 defines an obtuse inside angle with respect to the lower arm 34 of the engaging portion 18 of the holder 12. The obtuse inside angle may be an obtuse angle between 140° and 150°. Lastly, the rear arm 40 of the retaining portion 42 of the holder 12 may have a length between 6 cm and 10 cm.

A first bend 46 of the retaining portion 42 of the holder 12 defines a primary arm 48 of the retaining portion 42 of the holder 12. The primary arm 48 of the retaining portion 42 of the holder 12 extends upwardly from a bottom end 50 of the rear arm 40 of the retaining portion 42 of the holder 12. Moreover, the primary arm 48 of the retaining portion 42 of the holder 12 defines an acute inside angle with respect to the rear arm 40 of the retaining portion 42 of the holder 12. The acute inside angle may be an acute angle between 10° and 20°. Finally, the primary arm 48 of the retaining portion 42 of the holder 12 may have a length between 4 cm and 6 cm.

A second bend 52 of the retaining portion 42 of the holder 12 defines a secondary arm 54 of the retaining portion 42 of the holder 12. The secondary arm 54 of the retaining portion 42 of the holder 12 extends downwardly from a top end 56 of the primary arm 48 of the retaining portion 42 of the holder 12. A bottom end 58 of the secondary arm 54 of the retaining portion 42 of the holder 12 abuts a front side 60 of the primary arm 48 of the retaining portion 42 of the holder 12. The secondary arm 54 of the retaining portion 42 of the holder 12 may have a length between 2 cm and 3 cm. Finally, the retaining portion 42 of the holder 12 has an S-shaped cross section taken along a lateral axis extending through a first lateral edge 62 and a second lateral edge 64 of the retaining portion 42 of the holder 12.

In use, the holder 12 is positionable on the fixture 14 so the front arm 28 of the engaging portion 18 of the holder 12 abuts a top side 66 of a front casing 68 of the fixture 14. Moreover, the abutting section 24 of the engaging portion 18 of the holder 12 engages front casing 68 of the fixture 14 so the holder 12 is retained on the fixture 14. Continuing, a placard 70 is selectively positioned between the bottom end 58 of the secondary arm 54 of the retaining portion 42 of the holder 12 and the front side 60 of the primary arm 48 of the retaining portion 42 of the holder 12. The placard 70 is retained on the holder 12 so the placard 70 is visible to a user. Lastly, the placard 70 comprises a recipe card.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A hands free holding assembly for retaining a placard proximate a user, said assembly comprising:

an engaging portion of a holder configured to be operationally coupled to a fixture; and a retaining portion being attached to said engaging portion of said holder and being configured to engage the placard wherein the placard is retained at a position being visible to the user;

said engaging portion including:

a first bend on said engaging portion of said holder defining a rear arm of said engaging portion of said holder between a free end of said holder and said first bend;

an abutting section extending upwardly from said first bend such that said rear arm extends rearwardly from said abutting section;

a second bend of said engaging portion of said holder defining a front arm, said abutting section extending between from said first bend to said second bend, each of said first and second bends forming perpendicular angles in said engaging portion, said front arm extending forwardly from said abutting section, said front arm and said rear arm each lying in planes oriented parallel to each other; and a third bend of said engaging portion of said holder defining a lower arm of said engaging portion of said holder, said lower arm extending downwardly from a front end of said front arm, said lower arm being perpendicular to said front arm and parallel to said abutting section.

2. The assembly according to claim 1 further comprising a fourth bend of said holder defining a rear arm of said retaining portion of said holder.

3. The assembly according to claim 2 further comprising said rear arm of said retaining portion of said holder extending forwardly and downwardly from a bottom end of a lower arm of said engaging portion of said holder.

4. The assembly according to claim 3 further comprising wherein said rear arm of said retaining portion of said holder defines an obtuse inside angle with respect to said lower arm of said engaging portion of said holder.

5. The assembly according to claim 1 further comprising a first bend of said retaining portion of said holder defining a primary arm of said retaining portion of said holder.

6. The assembly according to claim 5 further comprising said primary arm of said retaining portion of said holder extending upwardly from a bottom end of a rear arm of said retaining portion of said holder.

7. The assembly according to claim 6 further comprising wherein said primary arm of said retaining portion of said holder defines an acute inside angle with respect to said rear arm of said retaining portion of said holder.

8. The assembly according to claim 5 further comprising:

a second bend of said retaining portion of said holder defining a secondary arm of said retaining portion of said holder;

wherein said secondary arm of said retaining portion of said holder extends downwardly from a top end of said primary arm of said retaining portion of said holder; and wherein a bottom end of said secondary arm of said retaining portion of said holder abuts a front side of said primary arm of said retaining portion of said holder.

9. A hands free holding assembly for retaining a placard proximate a user, said assembly comprising:

a first bend on an engaging portion of said holder defining a rear arm of said engaging portion of said holder extending rearwardly away from a bottom end of an abutting section of said engaging portion of said holder;

a second bend of said engaging portion of said holder defining a front arm of said engaging portion of said holder extending forwardly away from a top end of said abutting section of said engaging portion of said holder;

a third bend of said engaging portion of said holder defining a lower arm of said engaging portion of said holder extending downwardly from a front end of said front arm of said engaging portion of said holder;

a fourth bend of said holder defining a rear arm of a retaining portion of said holder extending forwardly and downwardly from a bottom end of said lower arm of said engaging portion of said holder wherein said rear arm of said retaining portion of said holder defines an obtuse inside angle with respect to said lower arm of said engaging portion of said holder;

a first bend of said retaining portion of said holder defining a primary arm of said retaining portion of said holder extending upwardly from a bottom end of said rear arm of said retaining portion of said holder wherein said primary arm of said retaining portion of said holder defines an acute inside angle with respect to said rear arm of said retaining portion of said holder;

a second bend of said retaining portion of said holder defining a secondary arm of said retaining portion of said holder extending downwardly from a top end of said primary arm of said retaining portion of said holder wherein a bottom end of said secondary arm of said retaining portion of said holder abuts a front side of said primary arm of said retaining portion of said holder;

wherein said holder being positionable on a fixture wherein said front arm of said engaging portion of said holder abuts the fixture wherein said abutting section of said engaging portion of said holder engages the fixture wherein said holder is retained on the fixture; and wherein the placard being selectively positioned between said bottom end of said secondary arm of said retaining portion of said holder and said front side of said primary arm of said retaining portion of said holder wherein the placard is retained on said holder;

said rear arm having a free end positioned opposite of said abutting section such that said rear arm extends between said free end and said first bend;

said abutting section extending between from said first bend to said second bend, each of said first and second bends forming perpendicular angles in said engaging portion, said front arm extending forwardly from said abutting section, said front arm and said rear arm each lying in planes oriented parallel to each other; and said lower arm being perpendicular to said front arm and parallel to said abutting section.

* * * * *